US007501381B2

(12) United States Patent
Kutami et al.

(10) Patent No.: US 7,501,381 B2
(45) Date of Patent: Mar. 10, 2009

(54) REVERSIBLE THERMOSENSITIVE RECORDING MEDIUM, IMAGE PROCESSING METHOD, AND IMAGE PROCESSING APPARATUS

(75) Inventors: Atsushi Kutami, Numazu (JP); Shin Yamamoto, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 309 days.

(21) Appl. No.: 11/224,963

(22) Filed: Sep. 14, 2005

(65) Prior Publication Data

US 2006/0063671 A1 Mar. 23, 2006

(30) Foreign Application Priority Data

Sep. 14, 2004 (JP) ..... 2004-267449

(51) Int. Cl.
*B41M 5/30* (2006.01)
*B41M 5/41* (2006.01)

(52) U.S. Cl. ..... 503/201; 503/226

(58) Field of Classification Search ..... None
See application file for complete search history.

(56) References Cited

U.S. PATENT DOCUMENTS

| | | | | |
|---|---|---|---|---|
| 5,278,128 | A | 1/1994 | Hotta et al. | |
| 5,283,220 | A | 2/1994 | Kawaguchi et al. | |
| 5,310,718 | A | 5/1994 | Amano et al. | |
| 5,448,065 | A | 9/1995 | Masubuchi et al. | |
| 5,583,554 | A | 12/1996 | Masubuchi et al. | |
| 5,700,746 | A | 12/1997 | Kutami et al. | |
| 5,869,421 | A | 2/1999 | Kutami et al. | |
| 5,869,422 | A | 2/1999 | Kazumi et al. | |
| 6,096,683 | A | 8/2000 | Amano et al. | |
| 6,154,243 | A | 11/2000 | Tatewaki et al. | |
| 6,177,383 | B1 | 1/2001 | Amano et al. | |
| 6,613,715 | B2 | 9/2003 | Kutami et al. | |
| 6,818,591 | B2 | 11/2004 | Arai et al. | |
| 6,942,156 | B2 * | 9/2005 | Ohta et al. | 235/492 |
| 7,131,594 | B2 * | 11/2006 | Ohta et al. | 235/492 |
| 7,238,642 | B2 * | 7/2007 | Shimbo et al. | 503/201 |
| 2005/0014645 | A1 | 1/2005 | Shimbo et al. | |

FOREIGN PATENT DOCUMENTS

| | | |
|---|---|---|
| JP | 2002-258751 | 9/2002 |
| JP | 2004-98539 | 4/2004 |
| WO | WO 03/091041 A1 | 11/2003 |

* cited by examiner

*Primary Examiner*—Bruce H Hess
(74) *Attorney, Agent, or Firm*—Oblon, Spivak, McClelland, Maier & Neustadt, P.C.

(57) ABSTRACT

To improve defective coloring at the time of forming an image as well as defective color erasing at the time of erasing an image, reducing damages of an information processing unit, the present invention provides a reversible thermosensitive recording medium which includes a support having flexibility, a reversible thermosensitive recording layer, an information processing unit having an information recording element, and a buffer layer, in which the information processing unit and the buffer layer are disposed on the opposite surface of the support on which the reversible thermosensitive recording layer is disposed.

18 Claims, 5 Drawing Sheets

REVERSIBLE THERMOSENSITIVE RECORDING MEDIUM, IMAGE PROCESSING METHOD, AND IMAGE PROCESSING APPARATUS

BACKGROUND OF THE INVENTION

1. Field of the Invention

The present invention relates to a reversible thermosensitive recording medium capable of improving defective coloring at the time of forming images as well as defective color erasing at the time of erasing images and reducing damages of an information processing unit, the image processing method, and the image processing apparatus.

2. Description of the Related Art

It has been known that providing an information processing unit with a reversible thermosensitive recording medium enables rewriting inside information of the information processing unit as well as forming an image in the reversible thermosensitive recording medium based on the recording information.

When an image is formed or erased in such a reversible thermosensitive recording medium, a heating apparatus such as a thermal head, a heat roller, and a ceramic bar is pressed against the reversible thermosensitive recording medium, and convex was formed on the reversible thermosensitive recording medium due to the presence of the information processing unit. Therefore, it is unable to uniformly heat the reversible thermosensitive recording medium when a heating apparatus is heated against the reversible thermosensitive recording medium, causing failures of color developing and color erasing. Further, the following problems arise when a heating apparatus is pressed against a reversible thermosensitive recording medium. At the portion where the information developing unit which comprises an information recording element is provided in the reversible thermosensitive recording medium, the information processing unit peals off from the reversible thermosensitive recording medium or is damaged.

Then, there have been a structure known in which only the area where a non-contact IC tag is not attached to a non-contact IC tag-mounted reversible thermosensitive recording medium is heated (see Japanese Patent Application Laid-Open (JP-A) No. 2004-98539). With the above structure, it is possible to prevent thermal damages of the non-contact IC tag and prevent nonuniformity in color erasing and color developing. However, with this method, the area used for forming an image is restricted.

On the other hand, a pressure sensitive adhesive sheet has been disclosed in Japanese Patent Application Laid-Open (JP-A) No. 2002-258751. The pressure sensitive adhesive sheet comprises a thermosensitive recording layer disposed on one side of a cushioning base and a tacky layer disposed on the opposite surface of the cushioning base, and the pressure sensitive adhesive sheet is affixed on a surface of a data carrier with an IC circuit having an antenna part and an information-memorizing part embedded into the base material. However, with this structure, it is hard to produce a reversible thermosensitive recording medium having flexibility because the information-memorizing part is embedded into the base material, and applications thereof are restricted.

SUMMARY OF THE INVENTION

The object of the present invention is to provide a reversible thermosensitive recording medium capable of improving defective coloring at the time of forming images as well as defective color erasing at the time of erasing images, reducing damages of an information processing unit, and having flexibility. The present invention is also to provide an image processing method of which images are formed or erased on the reversible thermosensitive recording medium, and an image processing apparatus in which images are formed or erased on the reversible thermosensitive recording medium by means of the image processing method.

A reversible thermosensitive recording medium of the present invention comprises a support having flexibility, a reversible thermosensitive recording layer, an information processing unit having an information recording element, and a buffer layer, in which the information processing unit and the buffer layer are disposed in a laminar structure on the opposite surface of the support on which the reversible thermosensitive layer is disposed.

According to the present invention, it is possible to present a reversible thermosensitive recording medium capable of improving defective coloring at the time of forming images as well as defective color erasing at the time of erasing images, reducing damages of an information processing unit, and having flexibility, because the information processing unit and the buffer layer are disposed in a laminar structure on the opposite surface of the support on which the reversible thermosensitive layer is disposed.

In the image processing method of the present invention, a variable energy is applied to the reversible thermosensitive recording medium of the present invention to thereby form and erase images on the reversible thermosensitive recording medium.

According to the image processing method of the present invention, it is possible to improve defective coloring at the time of forming images and defective color erasing at the time of erasing images, because images are formed and erased on the reversible thermosensitive recording medium by applying a variable energy to the reversible thermosensitive recording layer.

The image processing apparatus forms and erases images on the reversible thermosensitive recording medium by means of the image processing method of the present invention.

According to the image processing apparatus of the present invention, it is possible to improve defective coloring at the time of forming images and defective color erasing at the time of erasing images, because images are formed and erased on the reversible thermosensitive recording medium by applying a variable energy to the reversible thermosensitive recording layer.

DESCRIPTION OF THE PREFERRED EMBODIMENTS (Reversible Thermosensitive Recording Medium)

A reversible thermosensitive recording medium of the present invention comprises a support having flexibility, a reversible thermosensitive recording layer, an information processing unit having an information recording element, and a buffer layer and further comprises other layers in accordance with the necessity.

The information processing unit and the buffer layer are disposed in a laminar structure on the opposite surface of the support on which the reversible thermosensitive layer is disposed.

As shown in FIGS. 1A to 1C and 2A to 2C, the reversible thermosensitive recording medium of the present invention comprises support 11 having flexibility, reversible thermosensitive recording layer 12, information processing unit 13 having an information recording element, and buffer layer 14. The information processing unit 13 and the buffer layer 14 are disposed in a laminar structure on opposite surface of support 11 on which the reversible thermosensitive recording layer 12 is disposed. Herein, having flexibility means the property that when one end of an object is fixed, the opposite surface of the object can be weighed down in an angle from 45° to 90° by its own weight.

Figure 1A:
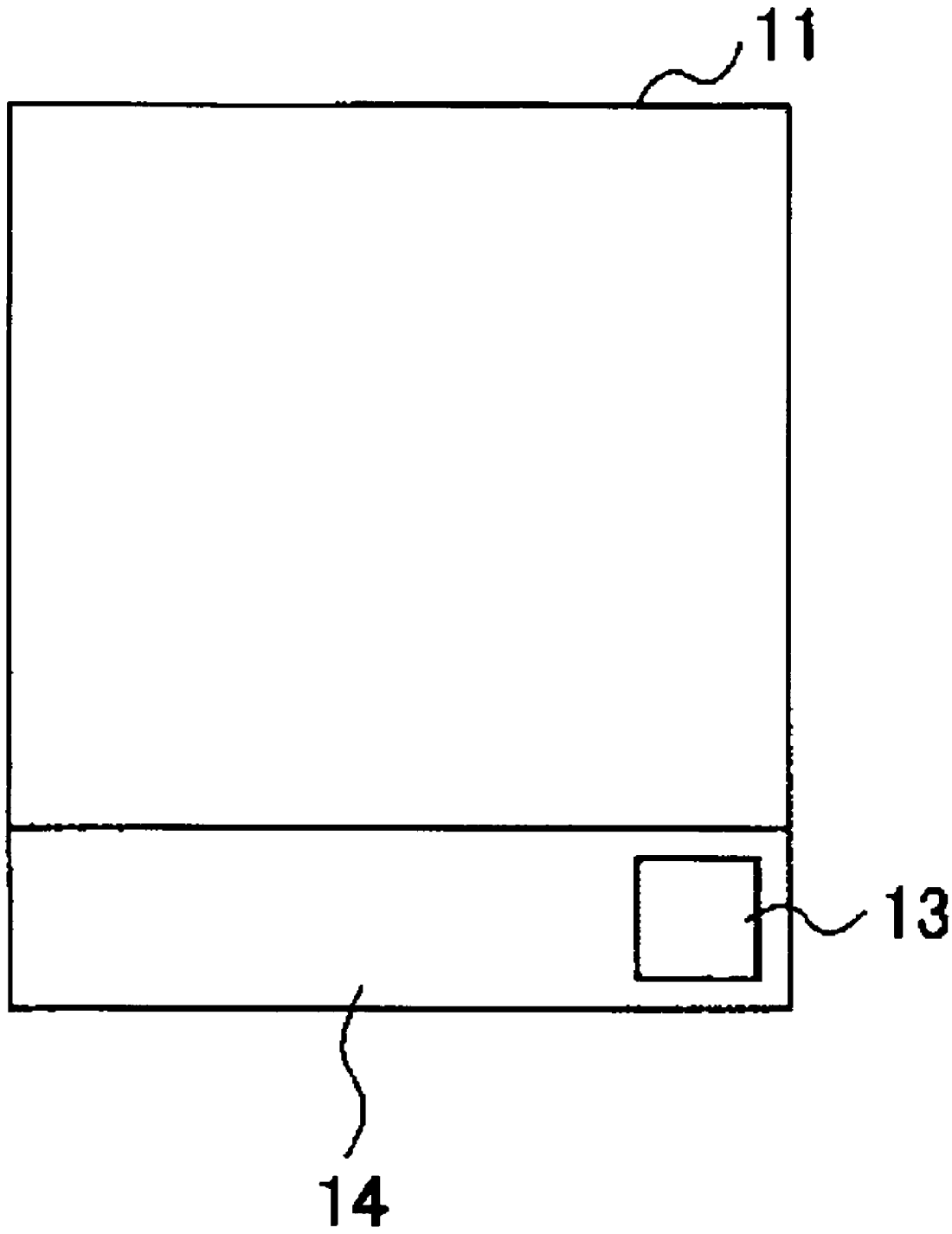
FIG. 1A is showing an example of the reversible thermosensitive recording medium of the present invention and is a surface view of the side of the reversible thermosensitive recording medium with an information processing unit and a buffer layer disposed thereon.
Figure 1B:
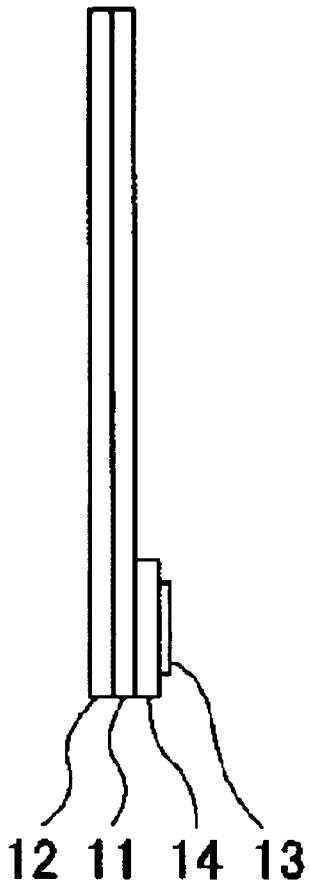
FIG. 1B is a cross-sectional view in a width direction of the side of the reversible thermosensitive recording medium shown in FIG. 1A with the information processing unit and the buffer layer disposed thereon.
Figure 1C:
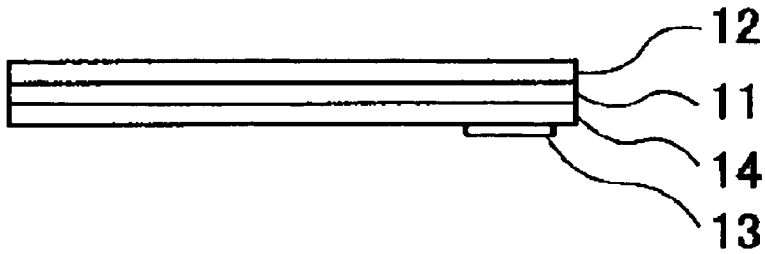
FIG. 1C is a cross-sectional view in a longitudinal direction of the side of the reversible thermosensitive recording medium shown in FIG. 1A with the information processing unit and the buffer layer disposed thereon.
Figure 2A:
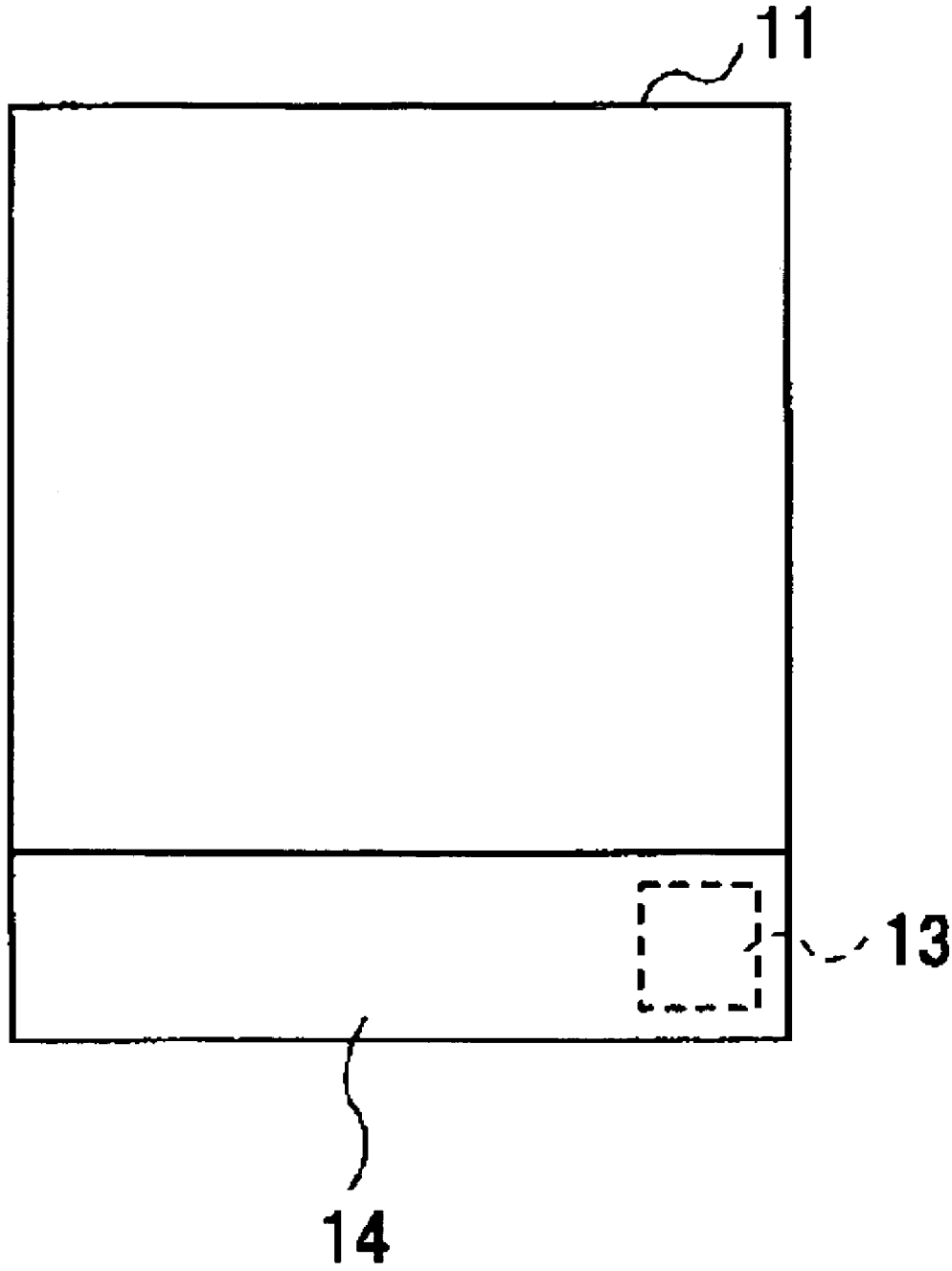
FIG. 2A is showing another example of the reversible thermosensitive recording medium of the present invention and is a surface view of the side of the reversible thermosensitive recording medium with an information processing unit and a buffer layer disposed thereon.
Figure 2B:
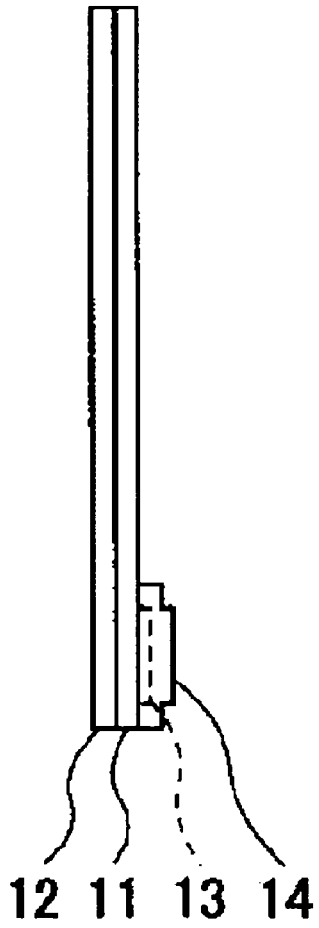
FIG. 2B is a cross-sectional view in a width direction of the side of the reversible thermosensitive recording medium shown in FIG. 2A with the information processing unit and the buffer layer disposed thereon.
Figure 2C:
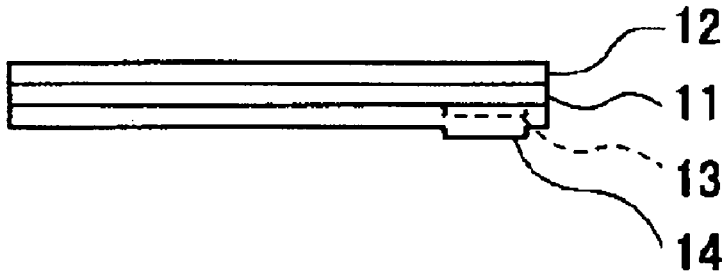
FIG. 2C is a cross-sectional view in a longitudinal direction of the side of the reversible thermosensitive recording medium shown in FIG. 2A with the information processing unit and the buffer layer disposed thereon.

FIGS. 1A, 1B, and 1C show a structure in which the buffer layer 14 is disposed between the support 11 and the information processing unit 13. FIGS. 2A, 2B, and 2C show a structure in which the information processing unit 13 is disposed between the support 11 and the buffer layer 14. FIGS. 1A and 2A respectively show a surface view of a reversible thermosensitive recording medium of the side on which an information processing unit and a buffer layer are disposed. FIGS. 1B and 2B respectively show a cross-sectional view of the reversible thermosensitive recording medium of the present invention in a width direction of the side with the information processing unit and the buffer layer disposed thereon. FIGS. 1C and 2C respectively show a cross-sectional view of the reversible thermosensitive recording medium of the present invention in a longitudinal direction of the side with the information processing unit and the buffer layer disposed thereon. With the structure stated above, convexoconcave or irregularities formed on a reversible thermosensitive recording medium caused by an information processing unit can be reduced when a heating apparatus makes contact with the reversible thermosensitive recording medium. Thus, it is possible to improve defective coloring at the time of forming an image and defective color erasing at the time of erasing colors as well as to reduce damages of an information recording element. Further, a reversible thermosensitive recording medium can have flexibility by forming it in a roll shape or in a sheet shape. It may be subjected to a secondary fabricating such as etching.

According to the reversible thermosensitive recording medium of the present invention, it is possible to check information recorded in the information processing unit without having a special apparatus for checking information and to improve user-friendliness because the recorded information is displayed on the reversible thermosensitive recording layer. For the information recording element used in the present invention, an IC chip is preferably used, and for the information processing unit, a non-contact IC tag is preferably used. The reversible thermosensitive recording medium can be used for in-out tickets, containers for frozen food, industrial products, stickers of containers used for a variety of pharmaceuticals, applications for logistics management, production process management, document management, and the like and can be processed in a generally used document size such as A4 size.

Figure 3:
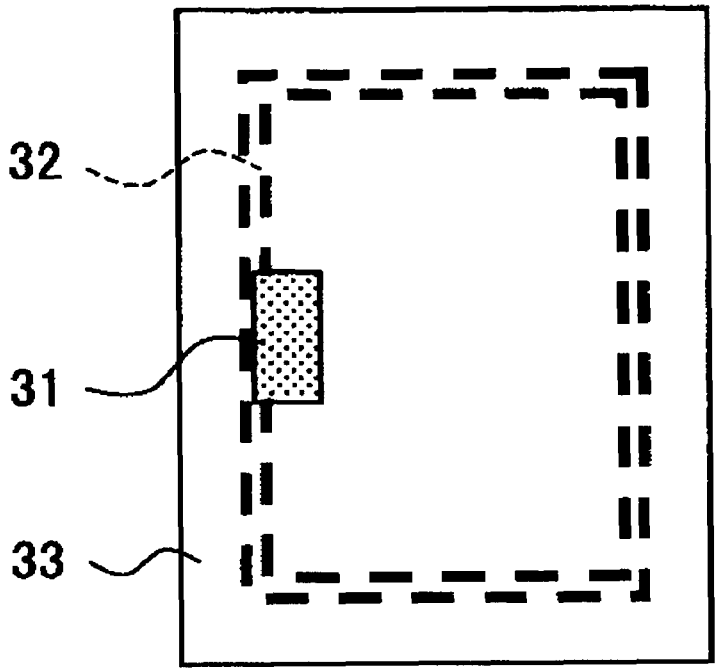
FIG. 3 is a view showing an example of an information processing unit used in the present invention.

As shown in FIG. 3, the information processing unit comprises IC circuit 31 and antenna circuit 32 each disposed on circuit board 33.

For base materials of the support used for the circuit board, it is possible to use rigid type materials such as commonly used paper phenol, glass epoxy, and composite, flexible type materials such as polyimide film, polyester film, paper, and synthetic paper, and combination type materials thereof. Examples of the method for providing with circuit wiring include the method of which a coiled metallic lead wire is arranged on a circuit board using an adhesive, the method of which a film is heated and pressurized to be deformed and then provided on a circuit board, the method of which a lead wire is arranged at a metallic portion in a circuit board with a metal such as copper and aluminum formed thereon is subjected to etching, the method of which circuit wiring is arranged after transferring a metallic foil formed with a conductive metal such as silver to a circuit board, and the method of which a conductive paste coating material is used on a circuit board to print a circuit wiring by means of silk screen printing and drying it to thereby form the circuit wiring.

The information processing unit is disposed by mounting an IC circuit on a circuit board with the circuit wiring arranged thereon and by electrically connecting the IC circuit through to an antenna circuit. The IC circuit is mounted to the circuit board by means of TAB (Tape Automated Bonding), COB (Tip On Board) and Flip Chip mounting. For mounting of the IC circuit and connecting it to an antenna circuit, typically used soldering, and a conductive adhesive can be used, however, in the course of the process, it is required to use the one having temperature conditions under which the circuit board is durable. At that time, to protect the IC circuit and the circuit wiring arranged on the circuit board, an IC circuit layer may be disposed on the IC circuit by packaging it with an epoxy resin or the like. The thickness of the IC circuit layer packaged with an epoxy resin is typically 150 μm or more and 1 mm or less. To protect the IC circuit, a protective film such as a polyimide film and a polyester film may be bound to the exposed surface of the IC circuit.

A adhesive layer for binding the information processing unit to the circuit board can be typically pressurized and bound to the circuit board under normal temperatures or heated conditions. Examples of the adhesive include aquiform anchor coating agents. Specifically, it is possible to apply EL-150 (manufactured by Toyo-Morton Ltd.) or a mixture of BLS-2080A (manufactured by Toyo-Morton Ltd.) with BLS-2080B (manufactured by Toyo-Morton Ltd.) to a polyurethane anchor coating agent, and it is possible to apply AD-503 (manufactured by Toyo-Morton Ltd.) to a polyester anchor coating agent. Preferably, the anchor coating agent is coated with a coated amount ranging from 0.5 g/m$^2$ to 25 g/m$^2$.

The information processing unit is preferably formed in a sheet shape because it is to be bound to a support having flexibility or a buffer layer for use. Further, the information recording element preferably has a smooth surface with no convex portion formed thereon. It should be noted that when an information processing unit having a typically used information recoding device is bound to a metallic surface of a circuit board and used, a magnetic flux is blocked by the metallic substance, and a sufficient electromotive force may not be ensured, therefore, an information processing unit which comprises a core having high magnetic permeability and an antenna coil or an information processing unit which comprises a core having high magnetic permeability, an antenna coil, and a conductive metal may be used. It is difficult to form the information processing unit stated above in a thin layer, however, it is greatly advantageous to form it in a sheet shape for use because a sufficient electromotive force can be obtained even when used on a metallic surface.

Materials of the tacky layer to which the information processing unit is bound can be selected from various types of materials depending on the type of the subject material, the environment in which the reversible thermosensitive recording medium is used, the strength of the adhesion, and the like. The adhesive layer can be disposed by coating a generally used waterborne or solvent pressure sensitive adhesive and drying it. These pressure sensitive adhesives can be used in a form of a solution of organic solvent or in a form of water dispersions such as dispersion, and emulsion.

The adhesive layer and the tacky layer are preferably disposed on the surface of the circuit board with the IC circuit mounted thereon so as not to be affected by convexoconcave or irregularities formed on the IC circuit. Further, to reduce difference in level of materials used in an information processing unit, it is preferred to use similar materials for the adhesive layer and the tacky layer and to have equivalent thicknesses thereof.

Examples of the main components of the adhesive layer and the tacky layer include urea resins, melamine resins, phenol resins, epoxy resins, vinyl acetate resins, vinyl acetate-acrylic copolymers, ethylene-vinyl acetate copolymers, acrylic resins, polyvinyl ether resins, vinylchloride-vinyl acetate copolymers, polystyrene resins, polyester resins, polyurethane resins, polyamide resins, chlorinated polyolefin resins, polyvinyl butyral resins, acrylic ester copolymers, methacrylic acid ester copolymers, natural rubbers, synthetic rubbers, cyanoacrylate resins, and silicone resins. Each of these components may be mixed each other in accordance with the application, and various additives may be added thereto. In addition, the adhesive strength can also be set in accordance with the necessity, and by using the one capable of ensuring a certain degree of adhesive strength at the portion of microscopic folds formed on the surface of the adhesive layer and the tacky layer, it makes the desorption of an information-recording part easy and can be repeatedly used. Further, with the one that has a high adhesive strength and is hardly pealed off after being mounted, it is possible to be used semipermanently. A sheet capable of pealing off such as pattern paper may be disposed in a laminar structure on the tacky layer or the adhesive layer to thereby form a reversible thermosensitive recording layer. Further, the surface other than the binding surface may be subjected to various treatments such as binding, water-repellent finishing, oil-repellent finishing, and static elimination process in accordance with the necessity.

In the present invention, when the buffer layer is viewed from a plane surface of the buffer layer, the area of the buffer layer preferably includes the area of the information processing unit. Specifically, the width of the area of the buffer layer is preferably equal to or more than the width of the area in which an image is formed on the reversible thermosensitive recording layer as well as equal to or less than the width of the area of the reversible thermosensitive recording layer. When the width of the area of the buffer layer is shorter than the area in which an image is formed on the reversible thermosensitive recording layer, there may be an area in which an image cannot be formed. On the contrary, the width is longer than the width of the area of the reversible thermosensitive recording layer, it is not favorable because it is difficult for an image forming apparatus to transport the reversible thermosensitive recording medium. In addition, the ratio of the length of the area of the buffer layer to the length of the area of the information processing unit is preferably 1 to 1.5. When the ratio is less than 1, the functions of the buffer layer cannot be fully exerted to the information processing unit. When the ration is more than 1.5, it is not favorable because it is hard to put the recording medium in the tray of an image forming apparatus.

The thickness of the buffer layer is preferably 0.5 times or more than the thickness of the information processing unit. When the thickness of the buffer layer is thinner than 0.5 times the thickness of the information processing unit, the functions of the buffer layer cannot be fully exerted.

The buffer layer preferably comprises materials selected from the group consisting of soft resin materials, mixed materials of hard resin materials and soft resin materials, mixed materials of inorganic materials and soft resin materials, sponge materials, and rubber materials. By adding such a material as components to the buffer layer, it is possible to improve defective coloring at the time of forming images and defective color erasing at the time of erasing images and to reduce damages of an information recording element. Examples of the soft resin materials include acrylic resins, bonded-fiber fabrics, and silicone resins. Examples of the hard resin materials include organic fillers. Examples of the inorganic materials include inorganic fillers. Examples of the sponge materials include foamed polyurethane resins. Examples of the rubber materials include NBR, and polyurethane resins.

The density of the sponge material is preferably 20 kg/m$^3$ to 60 kg/m$^3$. When the density is less than 20 kg/m$^3$, the buffer layer is so soft that the buffer layer is torn off and the information-recording part is in a naked condition. When the density is more than 60 kg/m$^3$, the surface of the buffer layer is so hard that difference in level arises between the reversible thermosensitive recording layer and the buffer layer, resulting in defective coloring and defective color erasing. Sponge materials having a density of 60 kg/m$^3$ or more or rubber materials preferably have a degree of hardness (JIS K6253) of 20 degrees to 70 degrees. When the degree of hardness is smaller than 20 degrees, it is so soft that the buffer layer is torn off. When the degree of hardness is greater than 70 degrees, the surface of the buffer layer is so hard that difference in level arises between the reversible thermosensitive recording layer and the buffer layer, resulting in defective coloring and defective color erasing.

The buffer layer preferably comprises an adhesive layer or a tacky layer having a content of at least one selected from curable resin materials and inorganic materials being 30% by mass to 90% by mass, on the surface thereof. This is because when an adhesive layer or a tacky layer is solely used on a buffer layer, the functions of the buffer layer are hardly exerted. By adding a material having a high degree of hardness to the materials of the buffer layer, flowability of the adhesive layer and the tacky layer is restricted, and the functions of the buffer layer can be exerted. When the above-noted content is less than 30% by mass, the effect of adding the material cannot be exhibited. When the content is more than 90% by mass, the degree of hardness of the adhesive layer and the tacky layer are so high that those layers go brittle. The curable resin and the inorganic material respectively have a fibrous, needle-like, spherical, or indefinite shape. These materials may be mixed for use or various additives may be added thereto in accordance with the application. Further, adhesive strength of these materials can be arbitrarily set in accordance with the necessity.

In view of convexoconcave or irregularities formed on the information-recording part and the buffer layer in a transporting direction at the time of forming and erasing images, the information-recording part and the buffer layer are preferably disposed at the start portion of the transportation or the end portion of the transportation of the reversible thermosensitive recording medium. When the material of the information-memorizing part is substantially different from that of the buffer layer, and when materials used in the information-memorizing part and the buffer layer are not known or in other cases, convexoconcave or irregularities seem to be greater when pressed by pressure caused by a heating apparatus, however, by disposing the information-memorizing part and the buffer layer as mentioned above, concavexoconcave or irregularities can be further reduced, resulting in improvements in defective coloring at the time of forming images and defective color erasing at the time of erasing images.

The reversible thermosensitive recording layer comprises materials reversibly changing color tones depending on changes in temperature. Changes in color tones are closely relating to changes in transmittance, reflectance, absorption wavelength, and scattered degree. In the reversible thermosensitive recording layer, the changes in these properties are combined to thereby display color tones. For the material reversibly changing color tones, the materials of which transparency and color tones are reversely changed by heat are preferable. Specifically, examples of the material include the one that can be in a primary color condition under a primary specific temperature which is higher than normal temperature and be in a secondary color condition by heating the material at a secondary specific temperature which is higher than the primary specific temperature and then by cooling it. Particularly, the one that changes in color conditions between the primary specific temperature and the secondary specific temperature is suitably used. For such as reversible thermosensitive recording layer, a reversible thermosensitive recording layer which comprises a leuco dye and a color developer is preferable.

Examples of the leuco dye include predyes known in the art such as phthalide compounds, azaphthalide compounds, and fluoran compounds, and each of these leuco dyes may be used alone or used as a mixture in combination of two or more.

Examples of the color developer include compounds each having one or more of a structure having color developing ability by which leuco dyes having a phenol hydroxyl group, a carboxyl group, a phosphate group in their molecules and a structure in which long-chain hydrocarbon groups controlling cohesion between molecules are linked each other, respectively. At the linked portion between the hydrocarbon groups, a linking group having divalent or more including a hetero atom may exist or at least one selected from a linking group similar to the long-chain hydroxyl group and an aromatic group may be included. Specific examples of the color developer include those disclosed in Japanese Paten Application Laid-Open (JP-A) Nos. 9-290563 and 11-188969, and each of these color developers maybe used alone or used as a mixture in combination with two or more.

To develop colors on the reversible thermosensitive recording layer, the reversible thermosensitive recording layer may be heated once at a temperature higher than the coloring temperature and then quenched. Specifically, since when the reversible thermosensitive recording layer is heated using a thermal head or a laser beam for a short time, the reversible thermosensitive recording layer is regionally heated, heat is immediately diffused, and the reversible thermosensitive recording layer is rapidly cooled and fixed in a color-developed condition. On the other hand, to erase colors, the reversible thermosensitive recording layer may be heated for a relatively long stretch of time using an appropriate heat source and then cooled or the reversible thermosensitive recording layer may be heated temporarily at a temperature slightly lower than the coloring temperature. When the reversible thermosensitive recording layer is heated for a long stretch of time, the temperature is raised at a wide range of the reversible thermosensitive recording layer, and the subsequent cooling down is delayed, therefore, erasing of colors arises in the course of the cooling down. For the heating method in the above process, a heat roller, a hot stamp, hot blow or the like may be used, or the reversible thermosensitive recording layer may be heated for a long stretch of time using a thermal head. To heat the reversible thermosensitive recording layer in the coloring temperature range, the energy applied to the reversible thermosensitive recording layer at the time of erasing colors may be lower than the energy applied thereto at the time of color developing by controlling, for example, voltage applied to a thermal head and a pulse width. Through the use of this method, color developing and erasing can be performed using only a thermal head, and so-called overwrite is enabled. In addition, it is also possible to erase colors by heating the reversible thermosensitive recording layer at a temperature within the erasing temperature range using a heat roller, and a hot stamp.

To improve and control coating properties and color-developing and erasing properties, additives may be added to the reversible thermosensitive recording layer. Examples of the additives include surfactants, conductive agents, fillers, antioxidizing agents, color-developing stabilizers, and color-erasing promoters.

The reversible thermosensitive recording layer comprises a resin besides the leuco dyes, the color developers, and the additives. For the resins used for the reversible thermosensitive recording layer, resins known in the art may be used alone or used as a mixture in combination with two or more, provided that these materials can be bound on the support. Of these resins, curable resins which can be cured by heat, ultraviolet rays, electron beam or the like are preferably used in order to improve durability of the reversible thermosensitive recording layer when repeatedly forming images, and in particular, thermosetting resins are preferably used. Specific examples thereof include resins having a group which is reactive to curing agents such as acryl polyol resins, polyester polyol resins, polyurethane polyol resins, polyvinyl butyral resins, cellulose acetate propionates, and cellulose acetate butyrates and resins copolymerized with monomers having a group which is reactive to curing agents. In addition, when the resin is cured, the rate of gel of the reversible thermosensitive recording layer is preferably 30% or more. When the rate of gel is lower than 30%, the cured condition is insufficient, and the durability is not sufficiently improved. The rate of gel of the reversible thermosensitive recording layer is more preferably 50% or more, and still more preferably 70% or more. The ratio of the mass of the resin relative to the mass of coloring components in the reversible thermosensitive recording layer is preferably in the range of 0.1 or more and 10 or less. When the ratio is smaller than 0.1, heat strength of the reversible thermosensitive recording layer is insufficient, and when the ratio is greater than 10, coloring density is reduced, causing some problems.

The curing agent is not particularly limited, may be suitably selected in accordance with the intended use, however, isocyanate curing agents are preferably used. Specific examples thereof include hexamethylenediisocyanate, tolylenediisocyanate xylylenediisocyanate, isophoronediisocyanate, and isocyanates of adduct type thereof, buret type thereof, and isocyanurate type thereof with trimethylolpropane, and blocked isocyanates, of which hexamethylenediisocyanate is preferable, and the adduct type thereof, buret type thereof, and isocyanurate type thereof are preferably used. The total amount of the curing agent added to the reversible thermosensitive recording layer should not exhibit curing reaction. Namely, unreacted curing agents may exist in the reversible thermosensitive recording layer. Further, when the resin is cured, a catalyst may be added thereto.

The reversible thermosensitive recording layer is disposed, on the support, using a coating solution prepared by uniformly dispersing a mixture which comprises a leuco dye, a color developer, various additives, a binder resin, a solvent, and the like. Specific examples of the solvent used for preparing the coating solution include alcohols, ketones, ethers, glycol ethers, esters, aromatic hydrocarbons, aliphatic hydrocarbons.

The coating solution is prepared by using a conventional dispersing apparatus for coating solution known in the art such as paint shaker, ball mill, Atlighter, three-roll mill, Kedy Mill, sand mill, Dino Mill, and colloid mill. Each of these materials may be dispersed in a solvent using a dispersing apparatus for coating solution or each of these materials may be respectively dispersed in a solvent and then mixed. Besides, each of these materials may be heated and dissolved and then quenched or subjected to cold-removal to be precipitated.

The coating method for forming the reversible thermosensitive recording layer is not particularly limited, and those known in the art may be used. Examples thereof include blade coating, wire bar coating, spray coating, air knife coating, bead coating, curtain coating, gravure coating, kiss coating, reverse roll coating, dip coating, and die coating.

Preferably, a protective layer is disposed on the reversible thermosensitive recording layer. With this structure, durability of the reversible thermosensitive recording layer can be enhanced. A resin similar to the resin used for the reversible thermosensitive recording layer can be used for the protective layer. Among resins, resins which are cured by ultraviolet rays and electron beam are preferably used. Examples of thereof include urethane acrylate resins, epoxy acrylate resins, polyester acrylate resins, polyether acrylate resins, vinyl resins, oligomers such as unsaturated polyester resins, various monofunctional and polyfunctional acrylates, methacrylates, vinyl esters, ethylene derivatives, and monomers of allyl compounds. When the resin is cured by ultraviolet rays, photopolymerization initiators, photopolymerization promoters, or the like are used.

The protective layer may comprise inorganic fillers, organic fillers, ultraviolet absorbers, lubricants, and coloring pigments. Examples of the inorganic fillers include carbonates, silicates, metallic oxides, and sulfate compounds. Examples of the organic fillers include silicone resins, cellulose resins, epoxy resins, nylon resins, phenol resins, polyurethane resins, urea resins, melamine resins, polyester resins, polycarbonate resins, styrene resins, acrylic resins, polyethylene resins, formaldehyde resins, polymethyl methacrylate resins. Examples of the ultraviolet absorbers include compounds having a salicylate structure, a cyanoacrylate structure, a benzotriazol structure, a benzophenone structure, and the like. Examples of the lubricants include synthetic waxes, vegetable-origin waxes, animal-origin waxes, higher alcohols, higher fatty acids, higher fatty acid esters, and amides. It should be noted that the solvent, dispersing apparatus for coating solution, the coating method or the like used for the coating solution for the protective layer are same as those used in the reversible thermosensitive recording layer, and the thickness of the protective layer is preferably 0.1 μm to 10 μm.

In the present invention, for the purposes of improving adhesiveness between the reversible thermosensitive recording layer and the protective layer, reducing degeneration of the reversible thermosensitive recording layer caused by coating in the protective layer, and reducing transition of additives in the protective layer to the reversible thermosensitive recording layer, it is preferred that an intermediate layer be disposed between the reversible thermosensitive recording layer and the protective layer. With this structure, it is possible to improve storage stability of images. In addition, through the use of resins having low-oxygen permeability for the protective layer and the intermediate layer disposed on the reversible thermosensitive recording layer, oxidization of coloring agents and color developers used in the reversible thermosensitive recording layer can be reduced.

The intermediate layer comprises resins such as thermosetting resins, thermoplastic resins, ultraviolet curable resins, and electron beam curable resins. Specific examples thereof include polyethylene, polypropylene, polystyrene, polyvinyl alcohol, polyvinyl butyral, polyurethane, and polyamide, and the intermediate layer may include a filler in accordance with the necessity.

Filler content by volume in the intermediate layer is preferably 1% to 95%, and more preferably 5% to 75%.

The intermediate layer may comprise the ultraviolet absorber used for the protective layer, and the content of the ultraviolet absorber in the resin used in the present invention is preferably 0.5% by mass to 10% by mass.

The thickness of the intermediate layer is preferably 0.1 μm to 20 μm, and more preferably 0.3 μm to 3 μm. It should be noted that the solvent, dispersing apparatus for coating solution, the coating method or the like used for the coating solution for the intermediate layer are same as those used in the reversible thermosensitive recording layer and the protective layer.

In the reversible thermosensitive recording medium of the present invention, preferably, a back layer is disposed on the opposite surface of the support on which the reversible thermosensitive recording layer is disposed. The back layer is disposed in order to restrain the reversible thermosensitive recording medium from curling caused by shrinkage of the resin used on the surface of the support on which the reversible thermosensitive recording layer is disposed, and the same resin as used in the protective layer is preferably used for the back layer. Further, besides the resin, similar to those used in the protective layer, a diluted solvent, inorganic fillers, organic fillers, lubricants, coloring pigments, and antistatic agents or the like may be added to the back layer. The back layer is the one that is disposed for the purpose of restraining shrinkage of the reversible thermosensitive recording medium on the surface of the reversible thermosensitive recording layer disposed thereon and is preferably coated such that the reversible thermosensitive recording medium is smooth and flat after coating.

In the present invention, it is preferred that a heat insulating layer be further disposed on the surface of the support on which the information processing unit and the buffer layer are disposed. With this structure, diffusion of heat is reduced, and forming and erasing of images are easily controlled. The heat insulating layer preferably comprises a chemical synthetic heat insulating material and hollow fine particles as main components.

Examples of the chemical synthetic heat insulating material include polymer foams such as polyurethane foam, polystyrene foam, vinyl chloride foam, or corrugated sheets such as plastic corrugate.

Examples of the hollow fine particles include micro hollow bodies which are formed with various materials such as glass, ceramics, and plastic. Examples of glass micro hollow body include a microsphere of borosilicate (Microsel M, manufactured by Gluperbell Co.). Examples of aminosilicate micro hollow body include a premix for low-foam injection and standard injection (Fillite, manufactured by Japan Fillite Co., Ltd.). Examples of the heat foamable micro hollow body include a formable plastic filler, Micro Pearl (manufactured by Matsumoto Yushi-Seiyaku Co., Ltd.) and Expancel (manufactured by Kemanord Kraft AB). A formable plastic filler is a hollow plastic filler having a foaming agent internally and a shell made from a thermoplastic resin externally and foams by heating. Examples of the thermoplastic resin include polystyrenes, polyvinyl chlorides, polyvinylidene chlorides, polyvinyl acetates, polyacrylate esters, polybutadienes, and copolymers thereof. Examples of the foaming agent include propanes, isobutenes, neo-pentanes, and petroleum ethers.

The hollow microparticles are used with a binder resin, and when the hollow microparticles are thermally-expandable microspheres, the one that have been already made into hollow microparticles is used before coating the hollow microparticles, however, microparticles can be hollowed by heating and foaming at the time of coating. The particle diameter of the hollow microparticles is preferably 10 μm to 100 μm, and more preferably 10 μm to 50 μm. Typically, the thickness of the hollow microparticle at the time of foaming is preferably 0.1 μm to 50 μm, and more preferably 0.2 μm to 20 μm.

In the present invention, instead of disposing a heat insulating layer, a support which can also serves as a heat insulating layer may be used. For such as support, typically, a plastic film or a synthetic paper is used, and a synthetic paper which comprises microvoid produced by inserting paper internally thereof.

In the present invention, it is preferred that a protective layer be further disposed on the surface of the support on which the information processing unit and the buffer layer are disposed. With this structure, it is possible to further reduce damages of an information recording element. It should be noted that the protective layer used herein comprises the same materials as those used in the above-mentioned protective layer.

(Image Processing Method and Image Processing Apparatus)

Figure 4:
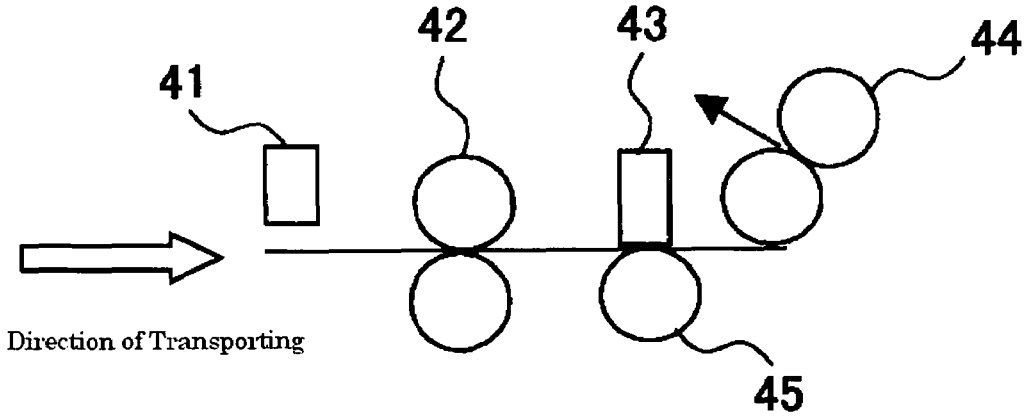
FIG. 4 is a view showing an example of an image processing apparatus used in the present invention.

As shown in FIG. 4, in the image processing apparatus of the present invention, antenna 41 recognizes information in the information recording part, an image formed in the reversible thermosensitive recording part is erased by heat roller 42, then another image is formed on the reversible thermosensitive recording part by thermal head 43, and the image is transported by transportation roller 44. The distance between the heat roller 42 and the thermal head 43 is preferably longer than the length of the reversible thermosensitive recording medium. With this structure, transportation speeds of the heat roller 42 and platen roller 45 can be independently controlled. To downsize the image processing apparatus, it is preferred that the speed of transporting the heat roller 42 be set at low-speed and the speed of transporting the platen roller 45 be set at high-speed.

In the image processing method of the present invention, a variable energy is applied to the reversible thermosensitive recording medium to thereby form and erase images. When forming or erasing an image, it is preferred that the energy be varied by varying the speed of transporting the reversible thermosensitive recording medium. With this configuration, it is possible to improve defective coloring and defective erasing between parts each having a different heat capacity in the reversible thermosensitive recording layer. In addition, since coloring and erasing are effectively performed, the image processing apparatus can be downsized. At this point in time, the ratio of the transportation speed of the part where the image processing unit is arranged in the reversible thermosensitive recording medium relative to the transportation speed of the part where the image processing unit is not arranged in the reversible thermosensitive recording medium is preferably 0.1 to 1. When the ratio is smaller than 0.1, the support is deformed, and when the ratio is greater than 1, defectiveness in coloring and erasing arises at the parts each having a different heat capacity. The transportation speed of the reversible thermosensitive recording medium can be changed by recognizing the speed through the use of a sensor reading the information processing unit or the like.

In the image processing method of the present invention, it is preferred that the energy applied to the reversible thermosensitive recording medium be varied by varying the temperature of a heat source used for applying the energy. With this configuration, defectiveness in coloring and erasing can be improved between the parts each having a different heat capacity. At this point in time, the ratio of the temperature of the heat source when applying the energy to the part where the image processing unit is arranged in the reversible thermosensitive recording medium relative to the temperature of the heat source when applying the energy to the part where the image processing unit is not arranged in the reversible thermosensitive recording medium is preferably ranging from 1 to 1.6. When the ratio is smaller than 1, defectiveness in coloring and erasing between the parts each having a different heat capacity, and when the ratio is greater than 1.6, the support is deformed. The temperature of the heat source can be changed by recognizing the conditions of the reversible thermosensitive recording medium through the use of a sensor reading the thickness and a sensor reading the information processing unit or the like.

In view of durability of the reversible thermosensitive recording medium, it is preferred that when the temperature of the reversible thermosensitive recording medium in which an image is erased is high, the energy given to the reversible thermosensitive recording medium at the time of forming an image be lowered, and when the temperature of the reversible thermosensitive recording medium in which an image is erased is low, the energy given to the reversible thermosensitive recording medium at the time of forming an image be raised. It should be noted that an example of the method for controlling the energy applied to the reversible thermosensitive recording medium include is the method in which movement of the heat roller, temperature of the reversible thermosensitive recording medium or the like are recognized.

In the image processing method of the present invention, it is preferred that the energy be initially applied to the part where the information processing unit is arranged in the reversible thermosensitive recording medium and then the energy be applied to the part where the information processing unit is not arranged in the reversible thermosensitive recording medium. This configuration enables initially forming an image at the part where the information processing unit is arranged by raising the temperature of the thermal head and then forming the image at the part where the information processing unit is not arranged with the thermal head of which temperature is lowered due to energy consumption as well as initially erasing an image at the part where the information processing unit is arranged by raising the temperature of the heat roller and then erasing the image at the part where the information processing unit is not arranged with the heat roller of which temperature is lowered due to energy consumption. Thus, this enables effectively utilizing energy from the heat source and also making the image processing apparatus a simplified image processing apparatus.

According to the present invention, it is possible to present a reversible thermosensitive recording medium capable of improving defective coloring at the time of forming images as well as defective color erasing at the time of erasing images, reducing damages of an information processing unit, and having flexibility and to present an image processing method in which images are formed or erased in the reversible thermosensitive recording medium and an image processing apparatus by which images are formed and erased in the reversible thermosensitive recording medium by means of the image processing method.

Hereinafter, the present invention will be described by means of examples, but it will be understood that the present invention is not construed as being limited thereto.

<Preparation of Reversible Thermosensitive Recording Sheet>

In a ball mill, 3 parts by mass of color developers represented by the following structural formula, 1 part by mass of dialkyl urea (Hakreen SB, manufactured by Nippon Kasei Chemical Co., Ltd.), 9 parts by mass of 50% by mass acryl polyol solution (LR327, manufactured by Mitsubishi Rayon Co., Ltd.), and 70 parts by mass of methyl ethyl ketone were poured and then crushed and dispersed so as to have a number average particle diameter of approx. 1 μm. To the dispersion liquid, 1 part by mass of 2-anilino-3-methyl-6-dibutylaminofluoran and 3 parts by mass of an isocyanate compound (Collonate HL, manufactured by Nippon Polyurethane Industry Co., Ltd.) were added and sufficiently stirred to thereby obtain a coating solution for reversible thermosensitive recording layer.

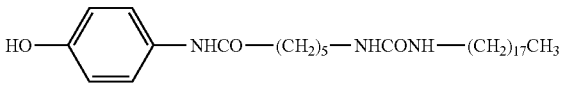

An opaque whitish polyester film having a thickness of 125 μm (TETRON FILM U2L98W, manufactured by TEIJIN DUPONT. FILMS JAPAN LTD.) was used as a support. When one end of the support was fixed, the opposite surface of the support was weighed down with an angle of 90° by its own weight, therefore, the support had flexibility. Then, a photothermal conversion layer and a masking layer were coated on one side of the support. Further, on the photothermal conversion layer and the masking layer, the coating solution for reversible thermosensitive recording layer was coated using a wire bar, dried at 100° C. for 2 minutes and then cured at 60° C. for 24 hours to thereby form a reversible thermosensitive recording layer having a thickness of 10 g/m$^2$.

Next, 3 parts by mass of a 50% by mass acryl polyol solution (LR327, manufactured by Mitsubishi Rayon Co., Ltd.) 7 parts by mass of 30% by mass of a 30% by mass zinc oxide fine particles dispersion liquid (ZS303, manufactured by Sumitomo Cement Co., Ltd.), 1.5 parts by mass of an isocyanate compound (Collonate HL, manufactured by Japan Polyurethane Industry Co., Ltd.) and 7 parts by mass of methyl ethyl ketone were sufficiently stirred to prepare an intermediate layer coating solution.

Next, the intermediate layer coating solution was coated on the support on which the reversible thermosensitive recording layer was disposed using a wire bar, and then the coated surface was died at 90° C. for 1 minute and cured at 60° C. for 48 hours to thereby form an intermediate layer having a thickness of 1 μm on the reversible thermosensitive recording layer.

Subsequently, 3 parts by mass of pentaerythritol hexaacrylate (KAYARAD DPHA, manufactured by Nippon Kayaku Co., Ltd.), 3 parts by mass of urethane acrylate oligomer Art Resin (UN-3320HA, manufactured by Negami Chemical Industrial Co., Ltd.), 3 parts by mass of dipentaerythritol caprolacton arylic ester (KAYARAD DPCA-120, manufactured by Nippon Kayaku Co., Ltd.), 1 part by mass of Silica-526 (manufactured by Mizusawa Chemical Industries Co., Ltd.), 0.5 parts by mass of photopolymerization initiator (Irgacure 184, manufactured by Chiba Geigy Japan Co., Ltd.), and 11 parts by mass of isopropyl alcohol were substantially stirred to prepare protective layer coating solution (1).

Next, on the support on which the reversible thermosensitive recording layer and the intermediate layer were disposed, the protective layer coating solution (1) was coated using a wire bar, heated and dried, and then cured using an ultraviolet ray lamp with a rated lamp power of 80 W/cm to thereby form a protective layer having a thickness of 4.5 μm.

The same composition used in the protective layer coating solution (1) was prepared and taken as a back layer coating solution.

On the opposite surface of the support of the recording layer on which the reversible thermosensitive recording layer, the intermediate layer, and the protective layer were disposed, the back layer coating solution was coated using a wire bar, heated and dried, and then cured using an ultraviolet ray lamp with a rated lamp power of 80 W/cm to thereby form a back layer having a thickness of 9 μm. The back layer was then subjected to a finishing treatment to be made an A4 size sheet to thereby prepare a reversible thermosensitive recording sheet.

<Preparation of Non-Contact IC Tag (1)>

A polyester film having a thickness of 25 μm, TETRON FILM HPE (manufactured by TEIJIN DUPONT. FILMS JAPAN LTD.) was used as a base, an electrolytic copper foil having a thickness of 35 μm was bound to the base with a bonding sheet and subjected to etching to form an antenna circuit in a card size. After surface polishing, washing, and drying of the antenna circuit, an IC circuit having a thickness of 200 μm was mounted on the surface with the antenna disposed thereon, and the surface thereof was embedded with an epoxy resin. On the back side of the base on which the IC circuit was not mounted, an acrylic tacky sheet having a thickness of 50 μm (Arontack HCV3700, manufactured by Toa Synthesis KK) was disposed to thereby prepare non-contact IC tag (1).

<Preparation of Non-Contact IC Tag (2)>

An electrolytic copper foil having a thickness of 35 μm was bound to a base of TETRON FILM HPE with a bonding sheet, and the surface was subjected to etching to form an antenna circuit in A4 size. After subjecting to the antenna circuit to surface polishing, washing, and drying, an IC circuit having a thickness of 200 μm was mounted on the surface with the antenna disposed thereon, and the surface thereof was embedded with an epoxy resin. On the IC circuit, a protective layer was disposed using an EVA adhesive sheet having a thickness of 300 μm and TETRON FILM HPE. Consequently, non-contact IC tag (2) which was reversible and capable of viewing information was prepared, in which a rubber-made tacky layer having a thickness of 30 μm was disposed on the polyester film.

<Preparation of Non-Contact IC Tag (3)>

A rubber-made tacky layer having a thickness of 50 μm was disposed as a buffer layer on a sheet-shaped IC tag constituted by a high magnetic permeability core, an antenna coil, and a conductive metal (length: 18.5 mm, width: 47 mm, thickness of layer: 1.8 mm) to prepare non-contact IC tag (3).

EXAMPLE 1

A non-contact IC tag-attached reversible thermosensitive recording sheet was prepared by binding a foamable polyurethane sheet having a thickness of 0.5 μm (Soflan W20, manufactured by Toyo Rubber Co., Ltd.) as a buffer layer to the back layer side of the reversible thermosensitive recording sheet and further attaching the non-contact IC tag (1) on the buffer layer. It should be noted that the size of the buffer layer was 209 mm×52 mm, and the size of the non-contact IC tag was 86 mm×54 mm.

With respect to the obtained non-contact IC tag-attached reversible thermosensitive recording sheet, images were printed at a speed of 25 mm/s using a printer (A) with both a thermal head and heat rollers provided therein (test production printer, manufactured by Tohoku Richo Co., Ltd.). As a result, nonuniformity of images, residue of image erasing, ground fogging of toner were hardly observed. The frequency of cracking of chip was 10/100 sheets. It should be noted that the frequency of cracking of chip was determined and evaluated with the number of sheets which had not been read by the IC chip through the printer among 100 sheets. The frequency of cracking of chip being 10/100 sheets means that cracking of chip was observed on 10 sheets of paper among 100 sheets.

EXAMPLE 2

A non-contact IC tag-attached reversible thermosensitive recording sheet was prepared by binding a foamable polyurethane sheet having a thickness of 0.5 mm (Soflan W60, manufactured by Toyo Rubber Co., Ltd.) as a buffer layer to the back layer side of the reversible thermosensitive recording sheet and further attaching the non-contact IC tag (1) on the buffer layer. It should be noted that the size of the buffer layer was 209 mm×52 mm, and the size of the non-contact IC tag was 86 mm×54 mm.

With respect to the obtained non-contact IC tag-attached reversible thermosensitive recording sheet, images were printed and erased at a speed of 25 mm/s using the printer (A), same as used in Example 1. As a result, nonuniformity of images, residue of image erasing, ground fogging of toner were hardly observed. The frequency of cracking of chip was 10/100 sheets.

EXAMPLE 3

A non-contact IC tag-attached reversible thermosensitive recording sheet was prepared by binding a double-sided tape made from a silicone material (9075, manufactured by Sumitomo 3M, Ltd.) as a buffer layer to the back layer side of the reversible thermosensitive recording sheet and further attaching the non-contact IC tag (1) on the buffer layer. It should be noted that the size of the buffer layer was 86 mm×52 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. The frequency of cracking of chip was 10/100 sheets.

EXAMPLE 4

A non-contact IC tag-attached reversible thermosensitive recording sheet was prepared by binding a double-sided tape made from a bonded-fiber fabric (9075, manufactured by Sumitomo 3M, Ltd.) as a buffer layer to the back layer side of the reversible thermosensitive recording sheet and further attaching the non-contact IC tag (1) on the buffer layer. It should be noted that the size of the buffer layer was 86 mm×53 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. The frequency of cracking of chip was 10/100 sheets.

EXAMPLE 5

A non-contact IC tag-attached reversible thermosensitive recording sheet was prepared by binding a single-sided tape having a hardness of 70 degrees (banpon, manufactured by Sumitomo 3M, Ltd.) as a buffer layer to the back layer side of the reversible thermosensitive recording sheet and further attaching the non-contact IC tag (1) on the buffer layer. It should be noted that the size of the buffer layer was 86 mm×50 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. The frequency of cracking of chip was 10/100 sheets.

EXAMPLE 6

A non-contact IC tag-attached reversible thermosensitive recording sheet was prepared by coating KE3475 having a thickness of 250 μm (manufactured by Shin-Etsu Chemical Co., Ltd.) as a buffer layer to the back layer side of the reversible thermosensitive recording sheet and further attaching the non-contact IC tag (1) on the buffer layer. It should be noted that the size of the buffer layer was 86 mm×50 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. The frequency of cracking of chip was 10/100 sheets.

EXAMPLE 7

A non-contact IC tag-attached reversible thermosensitive recording sheet was prepared by binding an acrylic tacky sheet having a thickness of 250 μm (Arontack HCV3700, manufactured by To a Synthesis KK) as a buffer layer to the back layer side of the reversible thermosensitive recording sheet and further attaching the non-contact IC tag (1) on the buffer layer. It should be noted that the size of the buffer layer was 210 mm×50 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. The frequency of cracking of chip was 10/100 sheets.

EXAMPLE 8

A non-contact IC tag-attached reversible thermosensitive recording sheet was prepared by binding an acrylic tacky sheet having a thickness of 250 μm (Arontack HCV3700, manufactured by Toa Synthesis KK) containing 50% by mass of a needle-shape filler (FT3000, manufactured by Otsuka Chemical Co., Ltd.) as a buffer layer to the back layer side of the reversible thermosensitive recording sheet and further attaching the non-contact IC tag (1) on the buffer layer. It should be noted that the size of the buffer layer was 210 mm×81 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. Further, there was no bleeding of dyes. The frequency of cracking of chip was 10/100 sheets.

EXAMPLE 9

In a ball mill, 30 parts of styrene-butadiene copolymer (PA-9159, manufactured by Nippon A & L Inc.), 12 parts by mass of polyvinyl alcohol (Poval PVA103, manufactured by KURARAY Co., Ltd.), 20 parts by mass of a hollow filler (Microsphere R300, manufactured by Matsumoto Yushi-Seiyaku Co., Ltd.), and 40 parts of water were sufficiently stirred to prepare a heat insulating layer coating solution. It should be noted that the size of the buffer layer was 210 mm×54 mm, and the size of the non-contact IC tag was 86 mm×54 mm.

A non-contact IC tag-attached reversible thermosensitive recording sheet was prepared by coating the heat insulating layer coating solution on the surface on the back layer side of the non-contact IC tag-attached reversible thermosensitive recording sheet prepared in Example 8 using a wire bar, heating and drying the coated surface to form a heat insulating layer having a thickness of 20 μm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. Further, there was no bleeding of dyes. The frequency of cracking of chip was 10/100 sheets.

EXAMPLE 10

In a ball mill, 30 parts by mass of an urethane-acryl ultraviolet curable resin (C4-175, manufactured by DAINIPPON INK AND CHEMICALS, INC.), 30 parts by mass of isopropyl alcohol, 10 parts by mass of toluene, and 5 parts by mass of calcium carbonate (Tunex E, manufactured by Shiroishi-Kougiyou Co., Ltd.) were sufficiently stirred to prepare protective layer coating solution (2).

A non-contact IC tag-attached reversible thermosensitive recording sheet was prepared by coating the protective layer coating solution (2) on the surface of the heat-insulating layer prepared in Example 9 using a wire bar, heating and drying the coated surface and then curing the surface using an ultraviolet ray lamp with a rated lamp power of 80 W/cm to form a protective layer having a thickness of 3 μm. It should be noted that the size of the buffer layer was 210 mm×81 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. Further, there was no bleeding of dyes, and no scratch was found on the back side of the non-contact IC tag-attached reversible thermosensitive recording sheet. The frequency of cracking of chip was 10/100 sheets.

EXAMPLE 11

A non-contact IC tag-attached reversible thermosensitive recording sheet was prepared by coating the protective layer coating solution (2) on the surface of the protective layer on the recording layer side of the non-contact IC tag-attached reversible thermosensitive recording sheet prepared in Example 10 using a wire bar, heating and drying the coated surface and then curing the surface using an ultraviolet ray lamp with a rated lamp power of 80 W/cm to form a protective layer having a thickness of 3 μm. It should be noted that the size of the buffer layer was 210 mm×54 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. Further, there was no bleeding of dyes, no scratch was found on the back side of the non-contact IC tag-attached reversible thermosensitive recording sheet, and there was no smears found on the protective layer. The frequency of cracking of chip was 10/100 sheets.

EXAMPLE 12

A polyurethane having a thickness of 300 μm and a density of 21 kg/m$^3$ (EFF, manufactured by Tsukasa Felt Shoji Co., Ltd.) was bound with a polyester adhesive so as to have a thickness of 350 μm, and further a rubber-made tacky layer having a thickness of 30 μm was disposed thereon to prepare buffer material (1). It should be noted that the size of the buffer layer was 210 mm×81 mm, and the size of the non-contact IC tag was 86 mm×54 mm.

A non-contact IC tag-attached reversible thermosensitive recording sheet was prepared by attaching a non-contact IC tag (2) on the back layer side of the reversible thermosensitive recording sheet and further binding the buffer material (1) thereto.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed.

Also, images were erased by setting the transportation speed for the part where the non-contact IC tag (2) was attached at 20 mm/s, a 20% slower than the speed set for the other parts. As a result, convex portions of images were erased, and occurrences of nonuniformity of images, residue of image erasing, ground fogging of toner were further reduced. The frequency of cracking of chip was 5/100 sheets.

EXAMPLE 13

A rubber sponge having a thickness of 300 μm, a rubber hardness of 40 degrees, and a density of 180 kg/m$^3$ (NBR4413, manufactured by Tsukasa Felt Shoji Co., Ltd.) was bound with a polyester adhesive to prepare buffer material (2) as a support having a thickness of 340 μm, and the back layer coating solution was coated on one side of the support using a wire bar and dried, and the dried surface was then cured using an ultraviolet ray lamp with a rated lamp power of 80 W/cm to form a back layer having a thickness of 10 μm.

A non-contact IC tag-attached reversible thermosensitive recording sheet was prepared in the same manner as Example 12, provided that the buffer material (1) used in Example 12 was changed to the buffer material (2). It should be noted that the size of the buffer layer was 210 mm×81 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, nonuniformity of images, residue of image erasing, ground fogging of toner were hardly observed. Further, no abnormal noise was heard, and the transportability was more excellent. The frequency of cracking of chip was 5/100 sheets.

EXAMPLE 14

A rubber-made tacky layer having a thickness of 50 μm was disposed on a rubber having a thickness of 1.8 mm to prepare buffer material (3).

The non-contact IC tag (3) was attached in the corner of the reversible thermosensitive recording sheet of Example 1, the buffer material (3) was bound next to the non-contact IC tag (3) to thereby prepare a non-contact IC tag-attached reversible thermosensitive recording sheet. It should be noted that the size of the buffer layer was 210 mm×81 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). At that time, the portion with the non-contact IC tag (3) attached thereon was outside of the scope for image forming, and only erasing was carried out, however, even when the heat roller was made contact with the non-contact IC tag-attached reversible thermosensitive recording sheet, residue of image erasing, ground fogging of toner were hardly observed. The frequency of cracking of chip was 3/100 sheets.

EXAMPLE 15

A polyurethane having a thickness of 300 μm and a density of 21 kg/m$^3$ (EFF, manufactured by Tsukasa Felt Shoji Co., Ltd.) was bound with a polyester adhesive so as to have a thickness of 350 μm, and further a rubber-made tacky layer having a thickness of 30 μm was disposed thereon to prepare buffer material (1).

A non-contact IC tag-attached reversible thermosensitive recording sheet was prepared by attaching a non-contact IC tag (2) on the back layer side of the reversible thermosensitive recording sheet of Example 1 and further binding the buffer material (1) thereto. It should be noted that the size of the buffer layer was 210 mm×81 mm, and the size of the non-contact IC tag was 86 mm×54 mm.

With respect to the obtained non-contact IC tag-attached reversible thermosensitive recording sheet, images s were printed and erased at a speed of 25 mm/s using the printer (A). As a result, nonuniformity of images, residue of image erasing, ground fogging of toner were hardly observed.

Also, images were erased by setting the erasing temperature for the part where the non-contact IC tag (2) was attached at 168° C., a 20% higher than the erasing temperature set for the other parts. As a result, convex portions of images were erased, and occurrences of nonuniformity of images, residue of image erasing, ground fogging of toner were further reduced. The frequency of cracking of chip was 3/100 sheets.

EXAMPLE 16

A non-contact IC tag-attached reversible thermosensitive recording sheet was prepared in the same manner as Example 1, provided that the buffer layer was bound to the back layer side of the reversible thermosensitive recording sheet so that the size of the buffer layer was 2 mm larger than that of the non-contact IC tag (1).

With respect to the obtained non-contact IC tag-attached reversible thermosensitive recording sheet, images were printed and erased at a speed of 25 mm/s using the printer (A). As a result, nonuniformity of images, residue of image erasing, smear on edge of the non-contact IC tag was visually smaller and hardly occurred, and the image was more brilliantly printed. Further, no abnormal noise was heard, and the transportability was more excellent. The frequency of cracking of chip was 5/100 sheets.

COMPARATIVE EXAMPLE 1

A non-contact IC tag-attached reversible thermosensitive recording sheet was prepared by attaching non-contact IC tag (1) on the back layer side of the reversible thermosensitive recording sheet. It should be noted that the size of the non-contact IC tag was 86 mm×54 mm.

With respect to the obtained non-contact IC tag-attached reversible thermosensitive recording sheet, images were printed and erased at a speed of 25 mm/s using the printer (A). As a result, image nonuniformity and residue of image erasing occurred at the part with the non-contact IC tag (1) attached thereon, and ground fogging of toner was observed at the edge of the non-contact IC tag (1). The frequency of cracking of chip was 100/100 sheets.

COMPARATIVE EXAMPLE 2

A non-contact IC tag-attached reversible thermosensitive recording sheet was prepared in the same manner as Example 1 except that PET-G having a thickness of 600 μm (PAC, manufactured by Mitsubishi Plastics, Inc.) was used as the support. When one end of the support was fixed, the opposite surface of the support was not weighed down by its own weight, therefore, the support does not have flexibility.

With respect to the obtained non-contact IC tag-attached reversible thermosensitive recording sheet, images were printed and erased at a speed of 25 mm/s using the printer (A). As a result, it was impossible to transport the non-contact IC tag-attached reversible thermosensitive recording sheet, and when the sheet was placed and stored in the case for the sheet, the non-contact IC tag-attached reversible thermosensitive recording sheet fractured.

REFERENCE EXAMPLE 1

A non-contact IC tag-attached reversible thermosensitive recording sheet was prepared by attaching the non-contact IC tag (2) on the back layer side of the reversible thermosensitive recording sheet and further binding a foamable polyurethane material EZQ-S having a density of 13 kg/m$^3$ (manufactured by Tsukasa Felt Shoji Co., Ltd.) thereto. It should be noted that the size of the buffer layer was 86 mm×50 mm, and the size of the non-contact IC tag was 86 mm×54 mm.

With respect to the obtained non-contact IC tag-attached reversible thermosensitive recording sheet, images were printed and erased at a speed of 25 mm/s using the printer (A). As a result, image nonuniformity and residue of image erasing occurred at the part with the non-contact IC tag (2) attached thereon, and ground fogging of toner was observed at the edge of the non-contact IC tag (2). The frequency of cracking of chip was 80/100 sheets.

REFERENCE EXAMPLE 2

A non-contact IC tag-attached reversible thermosensitive recording sheet was prepared in the same manner as Example 13, provided that the NBR4413 was changed to a natural rubber sponge N149 having a rubber hardness of 8 degrees and a density of 100 kg/m$^3$ (manufactured by Tsukasa Felt Shoji Co., Ltd.).

With respect to the obtained non-contact IC tag-attached reversible thermosensitive recording sheet, images were printed and erased at a speed of 25 mm/s using the printer (A). As a result, image nonuniformity and residue of image erasing occurred at the part with the non-contact IC tag (2) attached thereon, particularly at the convex portions, and ground fogging of toner was observed at the edge of the non-contact IC tag (2). The frequency of cracking of chip was 80/100 sheets.

REFERENCE EXAMPLE 3

A non-contact IC tag-attached reversible thermosensitive recording sheet was prepared in the same manner as Example 13, provided that the NBR4413 was changed to a rubber sponge having a rubber hardness of 10 degrees and a density of 180 kg/m$^3$ (C4205, manufactured by Tsukasa Felt Shoji Co., Ltd.).

With respect to the obtained non-contact IC tag-attached reversible thermosensitive recording sheet, images were printed and erased at a speed of 25 mm/s using the printer (A). As a result, image nonuniformity and residue of image erasing occurred at the part with the non-contact IC tag (2) attached thereon, particularly at the convex portions, and ground fogging of toner was observed at the edge of the non-contact IC tag (2). The frequency of cracking of chip was 80/100 sheets.

REFERENCE EXAMPLE 4

A non-contact IC tag-attached reversible thermosensitive recording sheet was prepared in the same manner as Example 13, provided that the NBR4413 was changed to a rubber having a rubber of 80 degrees (TBC80, manufactured by Kinugawa Rubber Industrial Co., Ltd.).

With respect to the obtained non-contact IC tag-attached reversible thermosensitive recording sheet, images were printed and erased at a speed of 25 mm/s using the printer (A). As a result, image nonuniformity and residue of image erasing occurred at the part with the non-contact IC tag (2) attached thereon, particularly at the convex portions. Because of the hardness of this rubber material, the frequency of cracking of chip was 70/100 sheets.

What is claimed is:

1. A reversible thermosensitive recording medium comprising:

a support having flexibility, a reversible thermosensitive recording layer, an information processing unit having an information recording element, and a buffer layer, wherein the information processing unit and the buffer layer are disposed on the opposite surface of the support on which the reversible thermosensitive recording layer is disposed, and wherein the buffer layer comprises at least one material selected from the group consisting of sponge materials and rubber materials.

2. The reversible thermosensitive recording medium according to claim 1, wherein the buffer layer is disposed between the support and the information processing unit.

3. The reversible thermosensitive recording medium according to claim 1, wherein the information processing unit is arranged between the support and the buffer layer.

4. The reversible thermosensitive recording medium according to claim 1, wherein the area of the buffer layer when viewed from a plane surface of the buffer layer includes the area of the information processing unit.

5. The reversible thermosensitive recording medium according to claim 4, wherein the width of the area of the buffer layer is equal to or greater than the width of the area forming an image on the reversible thermosensitive recording layer and is equal to or smaller than the width of the area of the reversible thermo sensitive recording layer, and the ratio of the length of the area of the buffer layer relative to the length of the area of the information processing unit is 1 to 1.5.

6. The reversible thermosensitive recording medium according to claim 1, wherein the thickness of the buffer layer is 0.5 times or more than the thickness of the information processing unit.

7. The reversible thermosensitive recording medium according to claim 1, wherein any one of an adhesive layer and a tacky layer is disposed on the surface of the buffer layer.

8. The reversible thermosensitive recording medium according to claim 7, wherein any one of the adhesive layer and the tacky layer comprises at least one material selected from curable resin materials and inorganic materials and the content of the material is 30% by mass to 90% by mass.

9. The reversible thermosensitive recording medium according to claim 1, further comprising a heat insulating layer on the surface of the support on which the information processing unit and the buffer layer are disposed.

10. The reversible thermosensitive recording medium according to claim 9, wherein the heat insulating layer comprises hollow particles.

11. The reversible thermosensitive recording medium according to claim 1, further comprising a protective layer on the surface of the support on which the information processing unit and the buffer layer are disposed.

12. An image processing method comprising:

applying a variable energy to a reversible thermosensitive recording medium to thereby form and erase an image, wherein the reversible thermosensitive recording medium comprises a support having flexibility, a reversible thermosensitive recording layer, an information processing unit having an information recording element, and a buffer layer, and the information processing unit and the buffer layer are disposed on the opposite surface of the support on which the reversible thermosensitive recording layer is disposed, and wherein the buffer layer comprises at least one material selected from the group consisting of sponge materials and rubber materials.

13. The image processing method according to claim 12, wherein the energy is varied by varying the speed of transporting the reversible thermosensitive recording medium.

14. The image processing method according to claim 13, wherein the ratio of the transportation speed of the part where the image processing unit is arranged in the reversible thermosensitive recording medium relative to the transportation speed of the part where the image processing unit is not arranged in the reversible thermosensitive recording medium is 0.1 to 1.

15. The image processing method according to claim 12, wherein the energy is varied by varying the temperature of a heat source from which the energy is applied to the reversible thermosensitive recording medium.

16. The image processing method according to claim 15, wherein the ratio of the temperature of the heat source when applying the energy to the part where the image processing unit is arranged in the reversible thermosensitive recording medium relative to the temperature of the heat source when applying the energy to the part where the image processing unit is not arranged in the reversible thermosensitive recording medium is ranging from 1 to 1.6.

17. The image processing method according to claim 12, wherein the energy is initially applied to the part where the information processing unit is arranged in the reversible thermosensitive recording medium and then the energy is applied to the part where the information processing unit is not arranged in the reversible thermosensitive recording medium.

18. An image processing apparatus comprising:

a reversible thermosensitive recording medium, and an image processing unit configured to apply a variable energy to the reversible thermosensitive recording medium to thereby form and erase an image on the reversible thermosensitive recording medium, wherein the reversible thermosensitive recording medium comprises a support having flexibility, a reversible thermosensitive recording layer, an information processing unit having an information recording element, and a buffer layer, and the information processing unit and the buffer layer are disposed on the opposite surface of the support on which the reversible thermosensitive recording layer is disposed, and wherein the buffer layer comprises at least one material selected from the group consisting of sponge materials and rubber materials.

* * * * *